United States Patent [19]

Bauer

[11] 3,940,575

[45] Feb. 24, 1976

[54] DIRECTIONAL MICROPHONE

[75] Inventor: Benjamin B. Bauer, Stamford, Conn.

[73] Assignee: CBS Inc., New York, N.Y.

[22] Filed: Mar. 3, 1975

[21] Appl. No.: 554,586

[52] U.S. Cl. ..... 179/121 D; 179/1 DM; 179/180; 181/158

[51] Int. Cl.[2] ..... H04R 1/38

[58] Field of Search ..... 179/1 DM, 121 R, 121 D, 179/138 R, 115.5 R; 181/158

[56] References Cited

UNITED STATES PATENTS

| | | | |
|---|---|---|---|
| 2,252,846 | 8/1941 | Giannini et al. | 179/121 D |
| 2,627,558 | 2/1953 | Wiggins | 181/158 |
| 2,801,294 | 7/1957 | Wurdel | 179/115.5 R |
| 3,240,883 | 3/1966 | Seeler | 179/121 D |
| 3,581,015 | 5/1971 | Masuda | 179/121 D |

*Primary Examiner*—Kathleen H. Claffy
*Assistant Examiner*—George G. Stellar
*Attorney, Agent, or Firm*—Spencer E. Olson

[57] ABSTRACT

A pressure gradient directional microphone of the moving coil type in which the acousto-mechanical function of the transducer is achieved by a vibratile diaphragm the major area of which is of coneiform shape and the central portion of which is of dome shape and of significantly smaller area and provides a surround for attaching the coil. One side of the diaphragm is exposed to the sound field surrounding the microphone, and the other side is exposed to two cavities, one of relatively large volume behind that portion of the diaphragm which is of coneiform shape, and a second behind the dome portion which is sufficiently smaller that it is unnecessary to provide any phase-shift action for any sound pressure generated therein. The diaphragm is secured at its periphery to a support ring having a plurality of openings formed therein which serve as acoustic ducts from the ambient into the larger cavity.

7 Claims, 8 Drawing Figures

DIRECTIONAL MICROPHONE

FIELD OF THE INVENTION

The present invention relates generally to microphones of the pressure gradient type, and more particularly to a dynamic microphone which displays a cardioidal directional pickup sensitivity.

BACKGROUND OF THE INVENTION

For use in areas where ambient noise levels are quite high, or where extraneous sounds would tend to become confused with principal voices or music, it is desirable to provide a microphone which can be aimed at a chosen source of sound with its back to unwanted noise. Microphones having a cardioid pattern of response are well known for use under these conditions, it being an object of the present invention to provide an improved microphone of this type. More particularly, the microphone according to the present invention embodies certain features and principles of directional microphones described in applicant Bauer's U.S. Pat. No. 2,237,298 and continuations-in-part thereof which issued as U.S. Pat. Nos. 2,305,596, 2,305,597 and 2,305,598, and in an article entitled "A Review of Cardioid Type Uni-Directional Microphones" appearing in the January 1940 issue of The Journal of the Acoustical Society of America, Volume 11, Page 296. Some of the material presented in these references is repeated here in summary form as background to an understanding of the present invention.

The directional characteristics of microphones are commonly described by a directional sensitivity, or polar, pattern of the kind illustrated in FIG. 1, in which the circle 10 depicts that a microphone 11 located at the center thereof has equal sensitivity, in terms of the output voltage, E, produced at the microphone terminals 12 and 13, to a plane progressive sound wave of r.m.s. sound pressure, $p$, regardless of the directional angle $\theta$ from which the sound wave $\theta$ impinges upon the microphone in the plane of the graph. Since microphones usually are symmetrical about an axis 0°–180° through the length of the microphone body, the circle 10 can also be regarded as the circumference of an imaginary sphere surrounding the microphone; that is, that the microphone is equally sensitive from all directions in space, or "omnidirectional." Assuming that the radius of the circle 10 represents the reference sensitivity of the microphone in terms of the signal voltage produced by sound pressure at the microphone, then half the radius would represent a 50 percent drop in sensitivity, corresponding to a level change of 20log0.5 =−6db, a quarter of the radius would represent a drop in sensitivity of 75 percent, corresponding to a level change of 20log0.25 = −12db, etc. In other words, the polar pattern of FIG. 1 is based on a linear voltage-pressure relationship along the radius vector; thus, if the sensitivity of an omnidirectional microphone is designated S, then in terms of the angle arrival $\theta$ in a plane through the axis of symmetry, $S$ is defined by the expression:

$$S = 1(\theta) \qquad (1)$$

This equation simply shows that the value of $S$ as a function of the angle $\theta$ is unity for all directions of sound arrival.

An important family of directional characteristics based on the so-called limacon family of patterns is characterized by the equation:

$$S = (1-k) + k\cos\theta \qquad (2)$$

which when $k = 0$ yields the omnidirectional pattern expressed by Eq. (1). For a value of $k = ½$, Eq. (2) becomes $S$=0.5 + 0.5cos$\theta$, and the dashed-line pattern 14 in FIG. 1 is produced, this being the familiar "cardioid" pattern. When $k$ has a value of 0.75, Eq. (2) becomes $S$=0.25 + 0.75cos$\theta$, and the pattern shown in dash-dot line is produced, with its major lobe 15*a* directed toward the front and with a smaller lobe 15*b* directed toward the back of the microphone. Finally, when $k$ has a value of 1.0, a "cosine pattern" is produced which is, in effect, bi-directional because it has lobes of equal sensitivity toward the front and the back as depicted by the dotted line circles 16*a* and 16*b*, respectively.

The nature of the present invention and the applicability thereto of the above theoretical discussion will be better understood from the following description of two different types of directional microphones disclosed in the aforementioned patents. FIG. 2 shows in stylized cross-section a microphone mechanism having a curvalinear coneiform diaphragm 20, the outer surface of which is exposed to the oncoming sound wave designated $p_1$. Normally this mechanism is mounted in a suitable foraminous case (not shown) for protection and ease of handling. Assuming that the wave arrives from the head-on or 0° direction as indicated, it must travel, because of the presence of the microphone case 22, an additional equivalent distance $d$ before it arrives to the passages 24 in the back of the case. At this point the sound wave has a pressure $p_2$ of the same magnitude as $p_1$, but differs from it in phase by an angle $\phi = 2\pi fd/c$. If the wave arrives at an angle other than 0°, the effective distance becomes $d_\theta$, which differs from $d$ by cos$\theta$, as depicted by the double arrow 25, which represents the equivalent distance $d$ projected upon the axis at 0°. Thus, the phase angle between $p_1$ and $p_2$ becomes $(2\pi fd/c)\cos\theta$, this factor being important to the explanation of the directional performance of the microphone.

The sound pressure $p_2$ causes an acoustical flow through apertures 24, which are usually covered by a fabric 26, causing compression of the volume of air within the cavity 28 defined by the inner surface of the diaphragm and the microphone case and development of a sound pressure $p_3$ therein. The pressure differential between $p_1$ and $p_3$ acting upon the diaphragm causes it to move, and via a connecting rod 30 to actuate a transducer 32 which generates an output voltage E at the transducer terminals 34 and 36.

Analyzing the acoustical elements of the microphone in terms of their electrical network equivalents, the mass of air in apertures 24 may be considered to approximate an inductance $L_A$, the flow resistance of the fabric 26 may be considered as a resistance $R_A$, and the volume of air within the cavity 28 may be considered as a capacitance $C_A$. When these elements are properly selected relative to the distance $d$ as taught in the aforementioned references, the pressure $p_3$ at the inner surface of the diaphragm can be made substantially equal to the pressure $p_2$ but displaced from it in phase by a preselected phase angle $\phi_1$. By designing the microphone so that the phase angle $\phi_1$ has a predetermined relationship with the phase angle $\phi$ the microphone can be made to have any desired sensitivity pattern within the range encompassed by Eq. (2). For example, when $\phi$ and $\phi_1$ are equal in magnitude the microphone has a cardioid polar pattern, as will be seen by examination of the phasor diagrams of FIGS. 2A and 2B. In FIG. 2A, which shows the sound pressure relationships corresponding to a 0° incidence of the wound wave, the phase angle $\phi=2\pi fd/c$ is the same as that produced by the phase shift network, $\phi_1$, the latter angle being selected to be equal to $2\pi fd/c$. The pressure difference across the diaphragm may be thought of as the length of a phasor connecting the ends of the arrows $p_1$ and $p_3$ as the direction of sound incidence changes as the sound source moves around the microphone, the phase angle $\phi$ is modified by the change of the equivalent distance $d_\theta$ by the factor $\cos\theta$, and the pressure phasor $p_1$ may be thought of as moving along the dashed-line from point *g* (for 0° incidence) down to point *h* (for 90° incidence) and finally down to point *i* (for 180° incidence). The latter situation is portrayed by the phasor diagram in FIG. 2B which shows that for rear incidence the two phasors $p_1$ and $p_3$ are coincident, there being, therefore, no pressure difference to actuate the diaphragm with the consequence that the output of the microphone is zero. The net sensitivity, as a function of the azimuth angle $\theta$ is clearly related to equation $S=0.5 + 5\cos\theta$, which defines the cardioid pattern described previously.

The aforementioned patents teach that acoustical networks for giving various type of transducers desired directional properties can take on a number of different forms and also describes ways of proportioning such networks, and the underlying theory need not be repeated here. Of particular significance to the present invention is that when a coneiform diaphragm is used to drive a transducer via a slim drive rod, the area of the diaphragm exposed to the interior cavity of the microphone is very nearly the same as the area exposed to the sound field, thereby ensuring that the forces across the diaphragm have very nearly the same relationship as the pressures whereby the desired limacon pattern is very nearly followed.

Because a moving coil or dynamic microphone is more rugged, and its impedance lower than the microphone just described, it would be desirable to incorporate the advantages of a coneiform diaphragm into a transducer of the moving coil type. However, this poses the design and structural problems exemplified by the moving coil microphone shown in stylized cross-section in FIG. 3. The diaphragm 40 of this known type of microphone consists of a dome 42 and a flexible rim 44, and has a circular coil of wire 46 attached at the juncture between the rim and the dome, the terminal leads 48 and 50 thereof which collect the voltage generated in the coil being brought out to the exterior of the microphone. The coil is immersed in a strong magnetic field produced in the gap between an inner pole-piece 52 and an outer pole-piece 54 produced by a magnet 56 and the surrounding return path member 58. In the conventional dynamic microphone, the dome 42 (also known as a piston) constitutes the most pertinent active area of the diaphragm and therefore is the principal contributor to the acousto-mechanical function of the transducer. The rim portion 44*a* provides a seal to the microphone case and flexibility, but because it rests upon the edge of the case, part of the force of the incident sound pressure is borne by the case and is not transmitted to the moving coil. Thus, the rim portion 44 has appreciably less influence upon the performance of the microphone than the dome portion, the main concern of the designer being to keep the rim axially flexible and tangentially stiff (to avoid spurious resonances), which is usually accomplished with corrugations and/or other stiffening devices.

The above-outlined advantage of having substantially equal inner and outer surfaces in the active region of the diaphragm would suggest that the dome area of the diaphragm in a moving coil microphone be made as large as possible, that spaced entrance ducts 60, depicted by the dashed lines, be provided around the rim of the diaphragm, and that these openings be covered with a fabric 62 to introduce a suitable acoustical flow resistance. This design approach has the shortcoming, however, that the sound pressure $p_3$ developed at the exit of ducts 60 would act upon the backside of the relatively ineffective rim area 44 of the diaphragm, and the acoustical flow would have to travel the added path between the moving coil and the magnetic structure indicated by the arrow 64 before generating the sound pressure $p_4$ within the cavity behind the dome area, the only significant active area in this type of microphone. These complications make it difficult to design a phase-shift network having appropriate interaction with the dome activity to achieve the desired directional sensitivity. Although the aforementioned patents suggest that the rim area be eliminated and the diaphragm be suspended on flexible metal tabs to allow main entry into the dome area to take place through a slit between the moving coil and the inner pole-piece of the magnetic structure, and other more contemporary designs attempt to circumvent the problem by providing passages between the moving coil and the diaphragm, all of these designs are complicated, are difficult to construct and suffer from a lack of mechanical strength and stability.

Accordingly, it is the primary object of the present invention to provide a directional microphone of the moving coil type having a relatively larger active diaphragm area than is exhibited by the diaphragms of known microphones of this type, and which is relatively simple to construct.

BRIEF DESCRIPTION OF THE INVENTION

Briefly, in the moving coil microphone according to this invention, the diaphragm has an outer portion of coneiform shape which intersects with a central portion of dome shape to form a surround for attaching the coil, the active area of the outer portion being much larger than the area of the dome portion. One side of the diaphragm is exposed to the sound field surrounding the microphone, and the other side is exposed to two cavities, one of relatively large volume behind the coneiform outer portion of the diaphragm, and the other of much smaller volume behind the dome portion, the larger cavity communicating with the smaller one via the air gap for the moving coil. The diaphragm is secured at its periphery to a support ring, which, in turn, is secured to the main body of the microphone, the support ring having a plurality of openings therein which serve as acoustic ducts through which the sound pressure enters to produce a volume velocity flow into the larger cavity. The ratio of the areas of the coneiform and dome portions of the diaphragm is such that the coil-driving force contributed by the dome area is so small relative to the contribution of the coneiform area that to first approximation it can be disregarded, thereby permitting application of known phase-shifting techniques to only the larger cavity to provide the desired directional properties. As a result of this, it is not necessary to provide special ducts between the two volumes under the dome and cone portions of the diaphragm, which results in a simple and sturdy structure.

BRIEF DESCRIPTION OF THE DRAWINGS

A better understanding of the construction and operation of the invention will be had from the following description taken in conjunction with the accompanying drawings, in which.

DESCRIPTION OF THE PREFERRED EMBODIMENT

Figure 1:
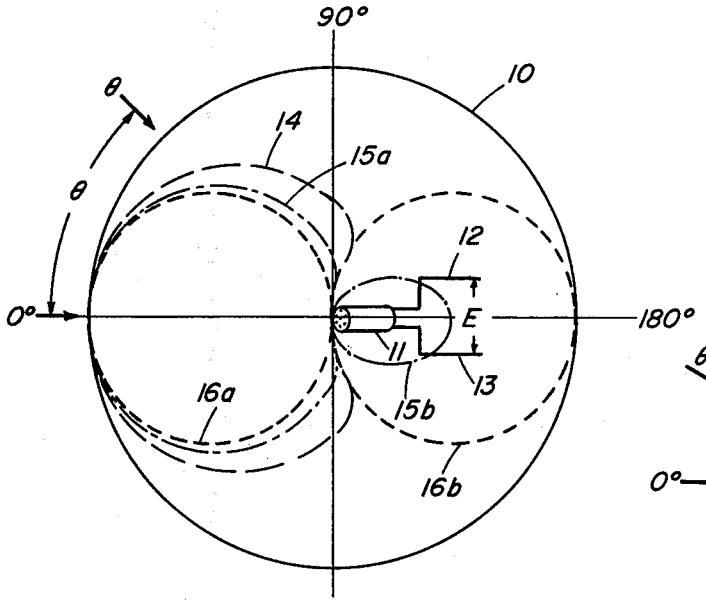
FIGS. 1, 2, 2A and B and 3 are diagrams useful in explaining the background of the invention, to which reference has already been made.
Figure 2:
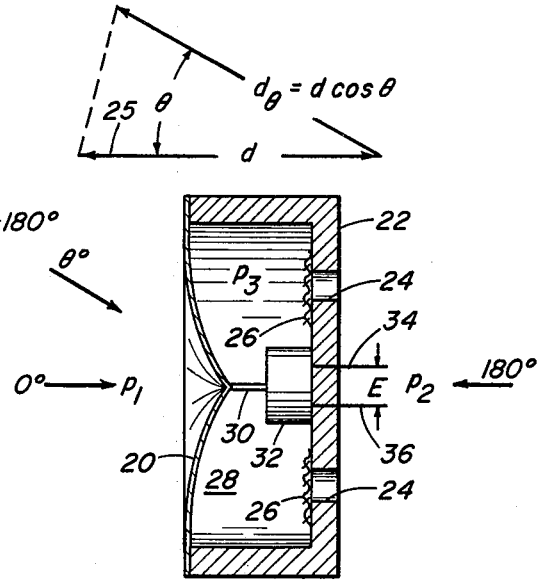
PRIOR ART FIG. 2
Figure 2A:
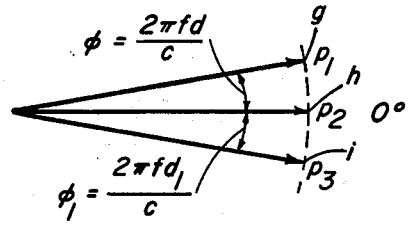
Figure 2B:
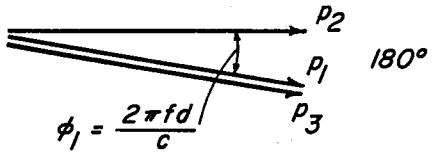
Figure 3:
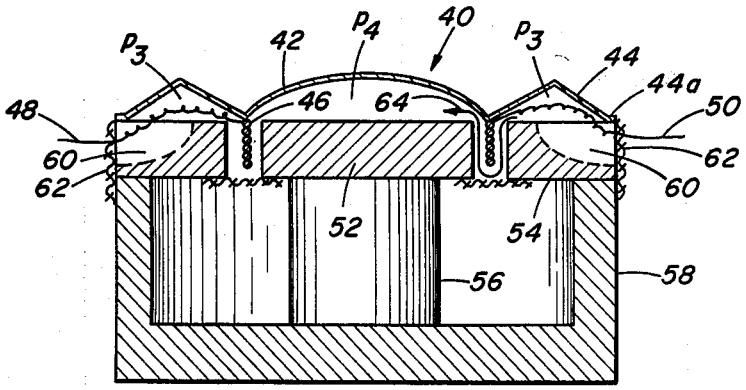
PRIOR ART FIG. 3
Figure 4:
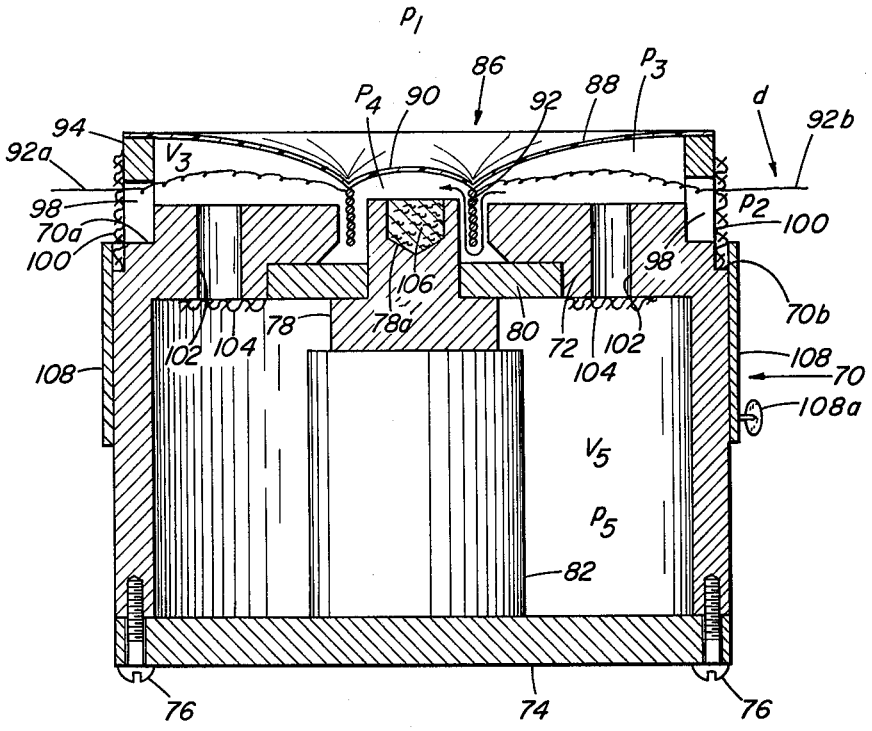
FIG. 4 is an enlarged cross-sectional view of the microphone according to the invention.

The microphone cartridge shown in cross-section in FIG. 4 comprises a main body portion 70 of cylindrical shape closed at one end by an annular pole-piece 72 and closed at the other end by a magnetic plate 74 secured to the wall of the main body, as by circumferentially distributed screws 76, for example, two of which are visible in FIG. 4. An inner pole-piece 78, centered within the central opening in the pole-piece 72, defines therewith an annular air gap for the moving coil (to be described), the centering being accomplished by a non-magnetic washer 80 tightly surrounding the inner pole-piece and engaging an annular recess formed on the inner surface of the annular pole-piece 72. A polarizing magnet 82 is held in axial alignment with the inner pole-piece 78 by the plate 74, and with the inner wall of the main body defines an annular cavity of volume designated $V_5$.

Figure 4A:
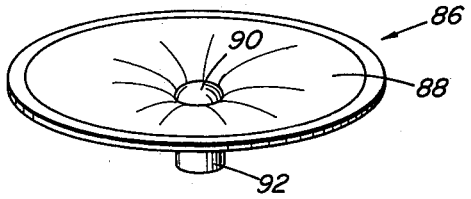
FIG. 4A is a perspective view of the diaphragm of the microphone of FIG. 4.
Figure 4B:
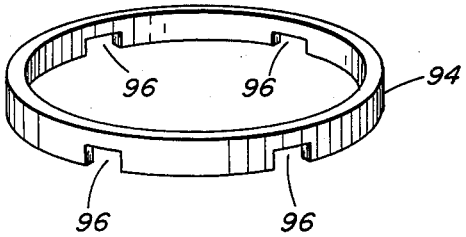
FIG. 4B is a perspective view of one form of the diaphragm mounting ring of the microphone of FIG. 4.

An important feature of the microphone is the construction of the diaphragm 86, which is of circular shape as shown in FIG. 4A, the major area of which is of coneiform shape 88 and the central portion 90 of which is of dome shape, with the intersection of the dome portion and the coneiform portion providing a circular surround for attaching a circular moving coil 92. The diaphragm is preferably made of mylar and is formed into the desired shape by pressing at elevated temperature utilizing known techniques. The diaphragm is cemented at its periphery to a support ring 94, shown in perspective in FIG. 4B, having a plurality of openings in the form of slots 96 milled in the lower edge thereof, the ring, in turn, being attached by cement to the main body 70 of the microphone. Alternatively, the ring may have a plurality of openings formed in the wall thereof. The ring and the body portion preferably are of the same diameter, with the ring 94 supported on a shelf 70*a* formed at the upper end of the body portion. The openings 96 serve as acoustic ducts 98 through which the sound pressure $p_2$ is adapted to produce a volume velocity flow into the interior of the microphone to produce a desired phase-shifted pressure $p_3$ within the cavity designated $V_3$ defined by the coneiform portion 88 of the diaphragm and the upper surface of the annular pole-piece 72. These openings also provide a convenient and direct way of bringing out the leads 92*a* and 92*b* from the moving coil 92. The magnetic field for the coil 92 is produced across the coil-receiving gap defined by the annular pole-piece 72 and the inner pole-piece 78 centered therein by the non-magnetic washer 80.

Reverting to the description of the diaphragm, in the preferred embodiment the diameter of the dome portion 90 is approximately one-fourth of the diameter of the unsupported diaphragm, thus having only approximately one-sixteenth of the net diaphragm area. Even considering that the coneiform portion 88 by reason of its being supported at its rim may be only approximately 80% effective, since the diameter of the dome portion is approximately (¼)/0.80) or 0.312 of the active diaphragm diameter, its area is approximately $0.312^2$ or only 0.099 of the active area of the diaphragm. Thus, the force contributed by the dome portion 90 is only approximately 10% of the total force available to drive the transducer coil 92 and its effect, therefore, on the overall performance of the microphone is quite small, sufficiently small that the dome area of the diaphragm may be disregarded and only the larger volume cavity behind the coneiform portion 88 need be considered in designing the phase-shifting networks necessary to give the microphone the desired directional properties.

The phase-shifting network design thus becomes straightforward, consisting of a band of fabric 100 affixed, as by cementing, to the outer periphery of support ring 94, with its lower edge supported on a narrow ledge 70*b* formed on the outer wall of the main body. The fabric 100 covering the entries 98 introduces an acoustical resistance of a suitable value to produce the proper phase-shift action. Another element of the acoustical network is provided by a plurality (eight in successfully operated embodiment) of apertures 102 in the annular pole-piece 72, two of which are shown in FIG. 4, for coupling the cavity $V_3$ behind the coneiform portion 88 of the diaphragm to the cavity $V_5$ within the main body portion of the microphone. The ends of apertures 102 remote from the diaphragm are covered with an acoustical resistance material, such as a strip of fabric 104. Alternatively, the fabric may be applied to the upper surface of the annular pole-piece 72 to cover the ends of the apertures nearest the diaphragm. The acoustical impedance of the ducts 98 and fabric 100, through which air flows from the atmosphere to the cavity $V_3$, followed by the fabric-covered apertures 102 which serve as acoustic ducts between the cavity $V_3$ and the cavity $V_5$, is essentially a counterpart of the acoustical elements of the phase-shift network shown in FIG. 10 of the aforementioned U.S. Pat. No. 2,237,298. Alternatively, instead of the apertures 102 and fabric 104, the non-magnetic washer 80 may be formed of a porous material having suitable acoustical impedance which, together with the air gap provides an acoustic duct between the cavity $V_3$ and the cavity $V_5$.

Because of the small area of the dome portion 90 relative to the overall effective area of the diaphragm, and consequently its small contribution to the acoustomechanical function or directional characteristic of the transducer, it is unnecessary to provide any special phase-shift action for any pressure $p_4$ produced within the small cavity defined by the dome and the upper end of the inner pole-piece 78.

Although not essential to the main purpose of this invention, the performance of the microphone may be improved by filling a recess 78*a* formed in the free end of the inner pole-piece 78 with sound-absorbent material 106, such as felt, for preventing resonances within the small cavity under the dome. The presence of the absorbent material allows the pressure $p_3$ in the larger cavity $V_3$ to become equalized with the pressure $p_4$ in the small cavity at very low frequencies to assist in the proper functioning of the microphone. At high frequencies, the impedance of the passage around the moving coil is too high to allow equalization of pressure, and the presence of the sound-absorbent material improves the high frequency performance.

The described construction of the microphone cartridge also makes it convenient to adjust its sensitivity pattern. For this purpose, a shutter 108 in the form of a sleeve or ring formed of a sound-impervious material, such as metal or plastic, for example, closely fitting around the outer periphery of the microphone, is adapted to be moved longitudinally of the body of the microphone, as by a small knob 108*a*, so as to cover a controlled fraction of the area of inlets 98 and thereby modify the impedance introduced by the ducts 98 and the fabric 100. When the shutter is positioned as shown in FIG. 4, the phase-shift network may be proportioned so that the microphone exhibits a hypercardioid polar pattern, whereas when the shutter covers approximately one-half of the area of the openings 98 a cardioid sensitivity pattern is obtained. When the shutter is moved to a position to completely close the openings 98, no sound flow from outside can enter the cavity $V_3$ and the microphone will then be responsive only to the outside pressure and approximately exhibit an omnidirectional sensitivity pattern. Thus, the provision of the sleeve 108 enables conversion of the otherwise unidirectional microphone to a microphone of the omnidirectional type.

The described construction enables making the microphone cartridge of practicable size while providing superior directional and response characteristics over the audible frequency range. In a preferred embodiment, the cartridge is 1 inch in diameter, 1 3/16 inches long, and has a substantially flat frequency response over a range from about 100 Hz. to 15,000 Hz. at a sensitivity level of about −75db. Its mechanical simplicity gives the cartridge ruggedness and performance in adjustment and operation, and makes its parts simple to construct and assemble. The impedance of the microphone is adjustable, by proper choice of winding for the coil, from about 50 ohms to about 150 ohms.

Since the invention resides in the construction of the microphone cartridge, a description of how it is mounted in the usual outer body has not been included. It will be understood, however, that the cartridge is to be shock-mounted within one end of a tubular outer body member, preferably of metal, shaped as a handle, with the front end allowing free access to the diaphragm and the acoustical ducts, and provided with a suitable terminal plug at the other end, and that the diaphragm would be surrounded with a suitable protective grille. Any other method of mounting which allows the sound waves to freely reach the diaphragm and the acoustical ports would be satisfactory.

It will now be apparent to those skilled in the art that the embodiment herein described may be variously changed and modified without departing from the spirit of the invention, the intended scope of which is defined in the accompanying claims.

I claim:

1. In a dynamic microphone, the combination comprising, a body closed at one end by an annular magnetic pole-piece, an inner magnetic pole-piece supported coaxially within said annular pole-piece and therewith defining a circular air gap, an annular diaphragm support having a diameter much larger than the diameter of said air gap supported on said body generally coplanar with said air gap, a circular vibratile diaphragm secured at its periphery to said annular support, said diaphragm having an active outer area portion of coneiform shape which intersects with a central portion of dome shape, the active area of said outer portion being larger than the area of said dome portion, a circular coil having a diameter substantially equal to the diameter of said dome portion secured to said diaphragm concentrically with said dome portion and supported within said air gap, one side of said diaphragm being adapted to receive external sound pressure and said coil producing electric output signals as a function of the sound pressure impinging upon the diaphragm, said diaphragm, said diaphragm support, and the surfaces of said annular and inner pole-pieces which confront said diaphragm enclosing a total volume divided by said air gap into two portions, the partial volume under the dome portion of the diaphragm being much smaller than the partial volume under the coneiform portion of the diaphragm, first duct means formed in said diaphragm support having acoustical impedance adapted to serve as an acoustic duct between the external atmosphere and said total volume, a second volume within said body enclosed in part by the surface of said annular pole-piece opposite the surface thereof which confronts said diaphragm, second duct means formed in said annular pole-piece having acoustical impedance adapted to serve as an acoustic duct between said total volume and said second volume, the acoustical impedance of said first and second duct means and said total and second volumes being so interrelated as to give the microphone a predetermined directional sensitivity pattern, the partial volume under the coneiform portion of said diaphragm being sufficiently larger than the partial volume under the dome portion of said diaphragm that any sound pressure generated within the partial volume under the dome portion does not significantly affect the directional sensitivity pattern.

2. Apparatus according to claim 1, wherein said annular support is a ring, and wherein said first duct means comprises at least one opening through said ring in which an acoustic resistance is provided, and further including means for adjusting the directional response of the microphone comprising, a sound impervious sleeve surrounding said body and adapted for adjustment therealong from a position at which it does not obstruct the openings in said ring to a position at which it effectively closes said openings to sound flow from the external atmosphere into said total volume.

3. Apparatus according to claim 1, wherein said annular support is a ring, and wherein said first duct means comprises at least one opening through said ring in which an acoustic resistance is provided.

4. Apparatus according to claim 3, wherein said said second duct means comprises at least one aperture through said annular pole-piece in which an acoustic resistance is provided.

5. Apparatus according to claim 1, wherein the area of said dome portion is approximately ten percent of the total active area of said diaphragm.

6. Apparatus according to claim 1, wherein the end of said inner pole-piece confronting said diaphragm has a recess therein filled with sound-absorbent material for preventing resonances within the partial volume under the dome portion of said diaphragm.

7. In a dynamic microphone, the combination comprising, a hollow cylindrical magnetic structure closed at one end by a flat annular pole-piece and at the other end by a magnetic plate, a polarizing magnet supported on said magnetic plate coaxially within said cylindrical structure and with the inner wall of said structure enclosing a cavity of annular shape, an inner pole-piece supported colinearly with said polarizing magnet and supported within said annular pole-piece and therewith defining an air gap, an annular diaphragm support having substantially the same diameter as said magnetic structure supported on said one end of said structure and extending beyond the outer surface of said annular pole-piece, a vibratible diaphragm secured at its periphery to said annular support, said diaphragm having an active annular outer portion of coneiform shape which intersects with a central portion of dome shape, the active area of said outer portion being larger than the area of said dome portion, a coil having substantially the diameter of said dome portion secured to said diaphragm concentrically with said dome portion and supported within said air gap, one side of said diaphragm being adapted to receive external sound pressure and said coil producing electric output signals as a function of the sound pressure impinging upon the diaphragm, said diaphragm, said diaphragm support and the said one closed end of the magnetic structure enclosing a total volume divided by said air gap into two partial volumes, a first partial volume under the coneiform portion of said diaphragm and a second partial volume under the dome portion, first duct means formed in said diaphragm support and having acoustical impedance adapted to serve as an acoustic duct between the external atmosphere and said first partial volume, means engaging said inner pole-piece and said annular pole-piece for acoustically sealing said air gap from said annular cavity, and second duct means formed in said annular pole-piece and having acoustical impedance adapted to serve as an acoustic duct between said first partial volume and said annular cavity, said first partial volume being sufficiently larger than said second partial volume that any sound pressure generated within said second partial volume does not significantly affect the directional sensitivity pattern of the microphone.

* * * * *